United States Patent [19]

Harris et al.

[11] 4,456,479

[45] Jun. 26, 1984

[54] VACUUM PURIFICATION OF LIQUID METALS

[76] Inventors: Ralph Harris, 371 Dulwich, St. Lambert, Quebec H2Z 2P4, Canada; William G. Davenport, 2036 East 3rd St., Tucson, Ariz. 85719

[21] Appl. No.: 475,964

[22] Filed: Mar. 16, 1983

Related U.S. Application Data

[63] Continuation-in-part of Ser. No. 367,262, Apr. 12, 1982.

[51] Int. Cl.[3] ..... C22B 9/04

[52] U.S. Cl. ..... 75/63; 75/68 R; 75/72; 75/82; 75/84; 266/211

[58] Field of Search ..... 75/49, 63, 68 R, 72, 75/82, 84; 266/208, 209, 210, 211

[56] References Cited

U.S. PATENT DOCUMENTS 3,607,231 9/1971 Hart ..... 75/76
4,191,559 3/1980 Linden et al. ..... 75/68 R

OTHER PUBLICATIONS

"Mineral Processing and Extractive Metallurgy"-Institute of Mining and Metallurgy Transactions Section C, Oct. 1980, pp. 147-152.

R. J. Andreini and J. S. Forster "Kinetics of Solute Removal During Electron-Beam and Vacuum-Arc Melting" J.Vac.Sci.Technol., vol. 11, No. 6, 1974, pp. 1055-1059.

A. Aarflot and F. Patak "Dynamic Vacuum Treatment of Molten Aluminum and its Alloys", Light Metals, 1976, vol. 2, Proc. 105th Aime, Las Vegas, Nev., pp. 389-401.

R. Ohno "Rates of Evaporation of Silver, Lead and Bismuth From Copper Alloys in Vacuum Induction Melting", Met.Trans., vol. 7B, Dec. 1976, pp. 647-653.

R. Ohno "Rates of Evaporation of Silver, Lead, Bismuth and Sulfur From Molten Copper Alloys Stirred at Different Speeds Under Reduced Pressure", Trans, Jim, vol. 18, 1977, pp. 232-238.

E. Ozberk and R. I. L. Guthrie "Vacuum Melting of Copper-Evaporation of Impurities", Proc. 6th Intl. Vac. Met. Conf., San Diego, 1979, pp. 248-267.

J. Aird, R. S. Celmer and A. V. May "New Cobalt Production From R. C. M. 's Chambishi Roast-Leach--Electrowin Process" Mining Magazine, Oct. 1980, pp. 320-336.

R. Bryan, D. M. Pollard and G. M. Willis "Removal of Bismuth From Copper by Vacuum Refining", Australia-Japan Ext. Met. Symp., Sydney, 1980, pp. 439-448.

*Primary Examiner*—W. Stallard
*Attorney, Agent, or Firm*—Bacon & Thomas

[57] ABSTRACT

Molten metals having a low vapor pressure, such as aluminum, are vacuum refined to remove metallic impurities employing a lifting gas to form a metal fall above a liquid metal surface; a vacuum above the metal surface is effective in conjunction with the lifting gas, to develop a bulk flow of rising gases between the liquid metal surface and a condenser; the pressure is higher, i.e. lower effective vacuum, than that which would cause such bulk flow in the absence of the lifting gas; a molten metal such as copper may be vacuum refined by creating a vacuum effective to cause emission from the liquid copper surface of the metallic impurities as a bulk flow of rising gases, in particular lifting the liquid copper from a lower level to at least the metal surface creates a circulation within the mass of copper effective to promote transfer of metallic impurities to the metal surface.

16 Claims, 4 Drawing Figures

VACUUM PURIFICATION OF LIQUID METALS

CROSS-REFERENCE TO RELATED APPLICATIONS

This application is a continuation-in-part of U.S. patent application, Ser. No. 06/367,262, filed Apr. 12, 1982.

BACKGROUND OF THE INVENTION

1. Field of the Invention

This invention relates to the refining of metals containing residual metals as impurities.

2. Description of the Prior Art

Many metals include small amounts of other metals, as residual metals, following smelting and preliminary refining operations. Scrap metals from various sources may also comprise residual metals.

The presence of residual metals often deleteriously affects the properties or workability of the contaminated metal, and removal of such residual metals is desirable.

It has previously been proposed to remove residual metals from molten steel by vacuum treatment. See, for example, Salomon-de Frieberg and Davenport, 'Vacuum Removal of Copper from Melted Steel Scrap', The Metallurgical Society of CIM, Annual Volume, 1977; Harris and Davenport, 'Pilot Plant Scale Vacuum Distillation of Liquid Steel to Remove Copper', Canadian Metallurgical Quarterly, Volume 18, 1979; Harris and Davenport, 'Vacuum Distillation of Liquid Metals: Part 1, Theory and Experimental Study', Metallurgical Transactions B, Volume 13B, December 1982, pages 581–591; and U.S. Pat. No. 4,227,922.

The work outlined in these prior references was particularly concerned with removal of residual metals from molten steel as distinct from other metals.

In U.S. patent application Ser. No. 367,262, the applicants disclosed the refining of steel containing residual metals and impurities and apparatus for this purpose. An essential feature of the described refining process is the subjection of the liquid steel containing metallic impurities in a bath, to a vacuum effective to cause emission from the liquid steel surface of the metallic impurities as a flow of rising gases. According to the invention, the surface of the molten steel is maintained substantially free of surface contamination and return of the residual metals into the molten steel is continuously prevented. Vacuum is maintained, throughout the treatment, at a level at which the emission is in the form of a bulk flow of rising gases which, in combination with the continual freeing of the surface of contamination and the continual prevention of the return of the impurities, reduces the time of the removal of impurities substantially to a minimum.

The applicants have also disclosed the use of a lifting gas, to lift liquid steel from a lower level in the bath to above the surface of the bath, and discharging the lifted steel to the surface of the bath to maintain it free of contamination. This latter expedient also has the advantage of exposing a large surface area of the lifted steel to the vacuum.

SUMMARY OF THE INVENTION

The applicants have now found that vacuum techniques are also applicable to the removal of metallic impurities from other molten metals, for example, aluminum, nickel, cobalt, titanium, and copper.

However, these metals all have their own special characteristics which must be taken into consideration when applying vacuum treatment. In operation a vacuum is maintained at a pressure lower than the vapor pressure of the molten metal. This may be practical in the case of molten steel, however, the group of metals comprising aluminum, nickel, copper, cobalt and titanium has such a low vapor pressure that it is difficult, if not impossible, to provide a lower vacuum pressure and this has discouraged researchers from attempting to remove metallic impurities from such metals by vacuum treatment.

In particular, liquid aluminum, copper, cobalt, nickel and titanium all have vapor pressures of less than about 1 pascal, whereas liquid steel has a vapor pressure of about 10 pascals.

The applicants have now found, however, that this problem can be overcome by combining the vacuum treatment with the injection of a lifting gas to supplement the emission of gas from the molten metal surface, and thus build up the bulk flow of rising gases to the point where effective removal of the metallic impurities or residual metals can be obtained at a rate sufficiently high as to make the process practical commercially.

The rate of emission of the impurity metals from the molten metal surface is controlled by three factors:

(a) transport of the metal to the molten metal surface from within the body of molten metal, (b) evaporation of the metal at the molten metal surface, and (c) transport of the evaporated metal away from the metal surface.

The factors which determine the rate of impurity removal when vacuum refining metals having low vapor pressure depends on the impurity being removed. Specifically, removal of impurities with high vapor pressure over the melt is controlled by factor (c), whereas removal of impurities with low vapor pressure will be controlled by factor (b). Removal of impurities with intermediate vapor pressure is controlled by both factors (b) and (c). The following Table lists for the low vapor pressure metals, the factor or factors which determine the rate of the particular impurity removal.

| | Low Pressure Metal | | | | |
|---|---|---|---|---|---|
| Impurity | Copper | Aluminum | Cobalt | Nickel | Titanium |
| Silver | b | — | b/c | b/c | — |
| Arsenic | b | — | — | b/c | — |
| Bismuth | c | — | c | c | — |
| Copper | — | — | c | b | b |
| Iron | — | b | b | — | b |
| Lithium | — | c | — | — | — |
| Lead | c | c | c | c | c |
| Magnesium | — | c | — | — | — |
| Sodium | — | c | — | — | — |
| Tin | — | b | b | b | b |
| Zinc | c | — | c | c | — |

In accordance with the present invention, a lifting gas is continuously injected into the molten metal to provide a lifting gas which enhances the bulk flow, i.e. factor (c) and forms a metal fall, thereby increasing the surface area of molten metal and thus enhancing the evaporation, i.e. factor (b).

However, the present invention also comprises the additional feature of creating a high level of melt mixing. This aspect of the invention also minimizes the effect of factor (a) and results in rates of refining which are impossible to attain in existing vacuum refining apparatus, for example, electron beam type vacuum refining apparatus in which a calm shallow bath is exposed to very high vacuum.

In accordance with the invention, there is provided a method of vacuum refining a molten metal having a low vapor pressure comprising forming a mixture of rising lifting gas and metallic gases evaporating from the surface of the molten metal, and subjecting the surface of the molten metal to a vacuum effective, in the presence of the lifting gas, to cause a bulk flow of rising gases from the molten metal surface, said vacuum having a pressure higher than the pressure required to cause a bulk flow of rising gases in the absence of lifting gas.

In particular the mixture may be formed by injecting the lifting gas through the molten metal and discharging liquid metal entrained in the lifting gas above the molten metal surface to drop in a metal fall onto the molten metal surface.

In a particular embodiment of the invention, there is provided a process for removing metallic impurities from a metal having a low vapor pressure, for example, aluminum, copper, cobalt, nickel and titanium, particularly metals having vapor pressure of less than 5 pascals at 100 ° K above their melting point, comprising, selecting an apparatus with a receptacle containing a bath of a molten metal having a low vapor pressure in a vacuum chamber and at least one conduit extending from below the surface of the molten metal to a point above the molten metal to provide for a metal fall, condensing means in the upper reaches of the vacuum chamber for condensing rising metallic gases, continuously injecting a lifting gas into a lower part of said conduit whereby liquid metal is lifted therethrough and discharged in finely divided form to drop in a metal fall onto the surface of the molten metal in the receptacle and a mixture is formed of said lifting gas and gases evaporating from said molten metal, subjecting the vacuum chamber to a vacuum effective, in the presence of the lifting gas, to cause a bulk flow of rising gases between the molten metal surface and the condensing means, said vacuum being lower than that which would cause a bulk flow of rising gases in the absence of lifting gas, continuously condensing the metallic rising gases on the condensing means to prevent reflux of impurities into the molten metal, thereby to increase the speed of removal of metallic impurities, restoring the pressure to normal, and recovering the treated metal.

Bulk flow of evaporated vapor, from the liquid metal surface to the condensing surfaces, differs in kind from diffusion of the evaporated vapor through the gas phase between the metal surface and the condensing surfaces. With bulk flow, there is a high mean velocity (up to several hundreds of meters a second) of evaporated vapor from the molten metal surface towards the condenser surfaces, which the applicants have observed, optically, as a directional stream leading towards the condenser surfaces. This contrasts with diffusion which takes place when the chamber pressure is greater than the melt vapor pressure, no directional (negligible net velocity) stream was observed, only a relatively stationary cloud of metal vapor.

In the case of molten copper the applicants also observed, not only that bulk flow of vapor away from the liquid metal can be achieved by decreasing the pressure within the vacuum chamber, but that the onset of bulk flow corresponds to a chamber pressure equal to the melt surface vapor pressure, and decreasing chamber pressure further increases the velocity of this bulk flow and evaporation rate. The applicants have also observed, in the case of molten copper that the evaporation rate reaches a maximum when chamber pressure is at a level of 10% to 30% of the total vapor pressure of the molten copper, and that operating within this range maximizes evaporation rate, while, at the same time, minimizes the expense of producing higher vacuum with the resultant wear and tear on the system.

Surprisingly, therefore, in face of prior art findings that vacuum treatment is too slow to be practical, through the use of the invention, a user is now able to obtain a substantially maximum refining rate for any given heat of copper and other metals having a low vapor pressure, and a practical treatment time of not more than about one hour, or even less, where the required tolerance of impurities is higher.

In the embodiments in which a lifting gas is employed, particularly for the case in which the molten metal has a low vapor pressure, for example, aluminum, it is found to be appropriate to inject the lifting gas so as to establish a bulk gas velocity in the bulk flow of rising gases of about 1 to about 100, preferably about 5 to about 20, meters per second; the bulk gas velocity being calculated across a horizontal cross-section taken through the body of the rising gases between the surface of the molten metal and the condensing surfaces.

An important criterion in successful operation is the lift factor or the overflow to submergence ratio, which is suitably 0.01 to 3 and preferably 0.5 to 1.5.

The lift factor is defined as the ratio of the lift height, i.e. the vertical distance from the surface of the molten metal in the vacuum chamber to the upper end of the lift conduit, to the gas injection nozzle submergence, i.e. the vertical distance from the surface of the molten metal in the vacuum chamber to the outlet of the injection nozzle.

The lifting gas is injected into the molten metal by means of an injection nozzle having its outlet adjacent the lower end of a vertical lift conduit through which the lifting gas rises, the conduit terminating at its upper end above the surface of molten metal in the vacuum chamber.

The lifting gas is suitably injected through the nozzle at a rate of 1 to 500 kg per hour for a bath of molten metal mass commensurate with associate processing facilities. A surface area exposed to vacuum of about 5 to about 500, preferably 70 to 110 $m^2$ is created by the metal spray during the metal fall.

BRIEF DESCRIPTION OF THE DRAWINGS

The invention is illustrated by reference to the drawings, in which.

DESCRIPTION OF THE PREFERRED EMBODIMENTS

Figure 1:
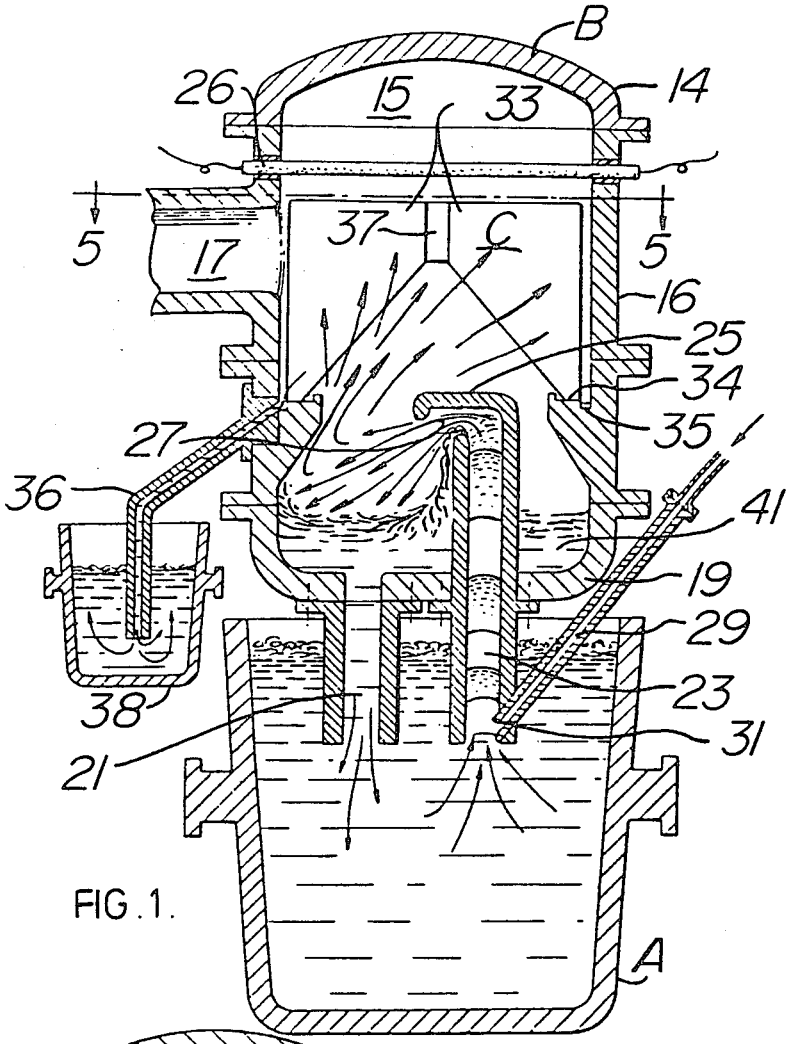
FIG. 1 is a vertical cross-section through a vacuum treatment apparatus in which molten metal is lifted from the level of the bath, and the residual metals are collected in liquid form.
Figure 2:
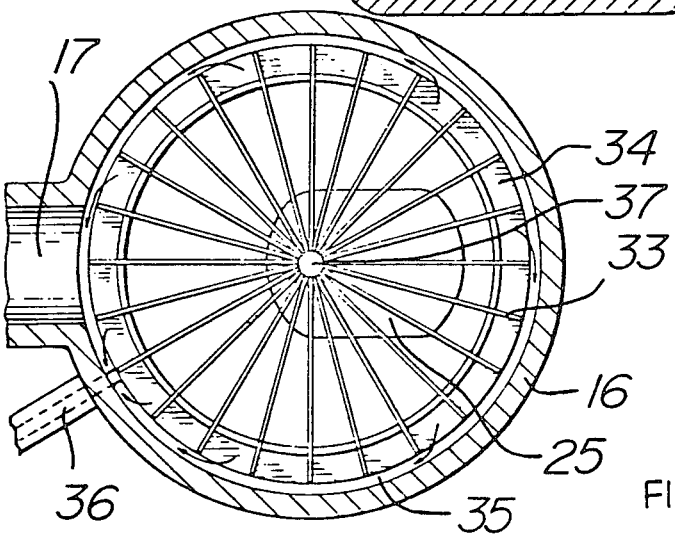
FIG. 2 is a horizontal cross-section along the line 2—2 of FIG. 1.

With further reference to FIGS. 1 and 2, A designates a refractory lined ladle. B identifies a vacuum chamber as a whole. The unit B includes a conduit 17 leading to a vacuum pump (not shown). The vacuum chamber B has a refractory lined steel shell 14. The unit B includes a removably connected hood 16.

A vapor condensing arrangement C, made up of a number of plates 33 having extensive surfaces, is located in the chamber 15. The plates 33 have feet 34 resting in a condensate collection trough 35. At their upper ends, the plates abut to form a central joint 37. The condensate trough 35 extends right around the chamber B and leads to a barometric leg 36 at one side of chamber B. The leg 36 leads to a collection vessel 38.

In the hood 16 is mounted heat transfer element 26. The element 26 may serve either to supply heat to or remove heat from the plates 33, as required.

Hollow leg or conduit 21 leads from below the surface of the metal in the ladle A, to the bottom of the receptacle 19.

A second hollow leg 23 leads from the level of the liquid metal in ladle A to well above the level of the metal in the receptacle 19 and terminates in a gooseneck part or hood 25 having an outlet 27 above the surface of the molten metal.

The legs 21 and 23 are of refractory material, for example, alumina, silicon nitride or stabilized zirconia. A lance 29 leads from a source (not shown) of lifting gas to a bottom part of the leg 23 where it terminates in an inlet or nozzle 31.

The nozzle 31 is preferably designed to produce large bubbles to create plug flow within the conduit 23. Plug flow is the condition created by a series of spaced-apart bubbles, which each occupy the entire cross-section of the up-leg 23. To this end, the nozzle should have an orifice Reynolds number less than 500. In the event of injecting a reactive gas, the nozzle 31 may be provided with protective means against thermal and chemical degradation. For example, it may have means for simultaneously injecting cooling or endothermic shrouding gas annularly about a main nozzle.

In operation, the molten metal is lifted by the lifting gas to well above the level of the molten metal in the receptacle 19. As the molten metal passes through the gooseneck part 25, its path is inverted, and it is released in finely divided form through the outlet 27. The lifting gas and the gas from the distillation of metallic impurities expands violently, dispersing the liquid metal within the gooseneck 25. The resulting explosive mixture of molten metal, inert gas and gasified volatile metals is expelled downwards, so that the metal is sprayed from the outlet 27 in finely dispersed form of streams and drops and bombards the surface of the molten metal bath 41 in the receptacle 19, keeping it free of surface film. At the same time, the gaseous content of flow in leg 23 separates from the metal and leaves the outlet 27 whence it rises upward. The condensable gases (metallic impurities) are intercepted by the condensing surfaces 33 on which they condense as liquid. The non-condensable lifting gas flows out through the exhaust passage 17.

The liquid from the surfaces 33 runs to the receiving trough 35 and is led therefrom through the barometric leg 36 to the collecting vessel 38.

Placing the outlet 27 sufficiently far above the level of the surface of the molten metal in the receptacle 19 provides a fall to the molten metal surface effective to furnish good evaporation from the falling metal droplets and leave should be taken to place the condensing surfaces 33 as close as possible to the molten metal surface without being close enough to be splashed.

Figure 3:
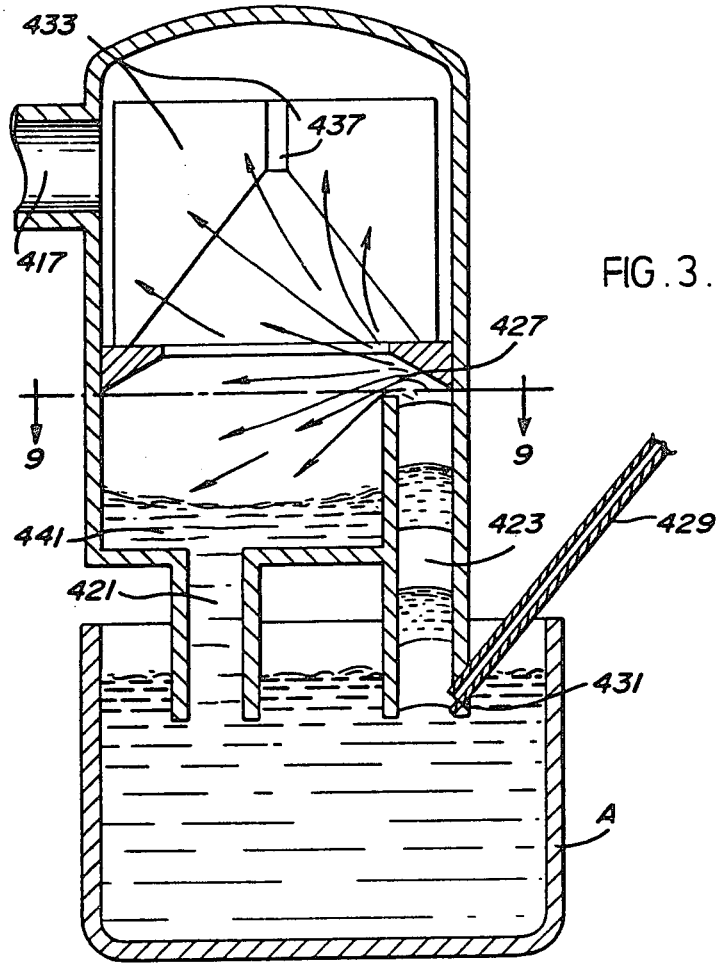
FIGS. 3 and 4 show alternative embodiments of the apparatus in which residual metals are collected in solid form.
Figure 4:
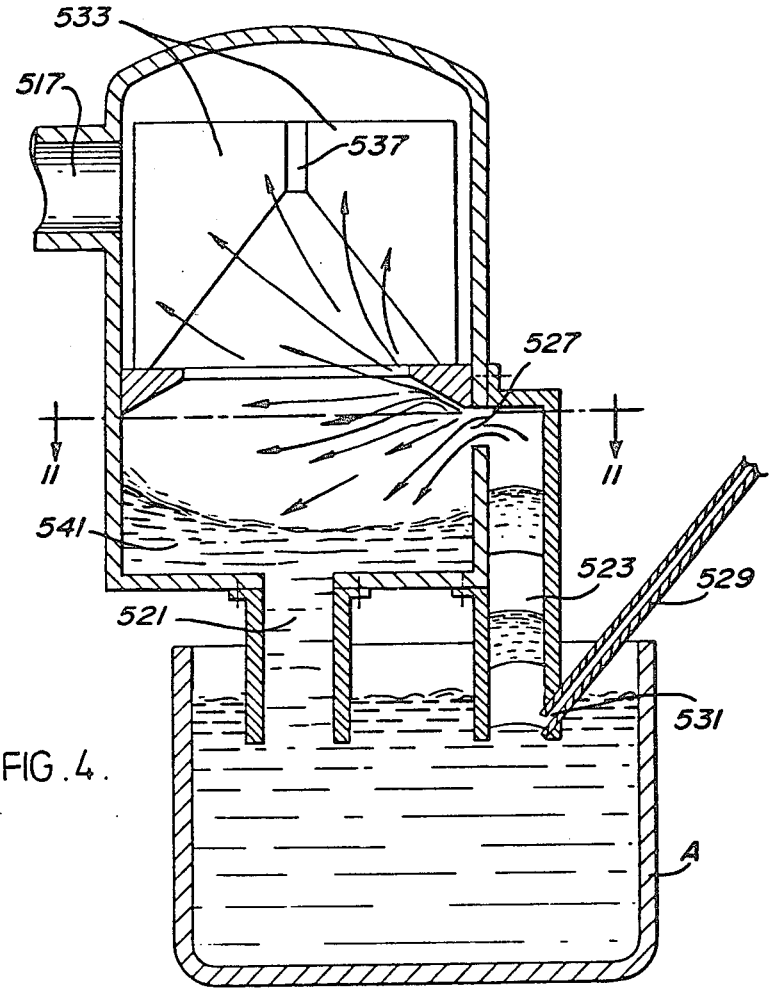

FIGS. 3 and 4 illustrate in vertical cross-section further forms of units which may be employed in the processes of the invention. Similar reference letters and numerals have been applied to the various parts except that the letters have been given a respective subscript 4 and 5 and the reference numerals are in the 400's and 500's. The arrangements of FIGS. 3 and 4 place the respective up-leg 423 and 523, respectively, in position where the sidewall of the vessel is employed as part of it and the leg is less exposed to temperature and other effects within the vacuum chamber.

In FIGS. 3 and 4, the metallic vapors are condensed to a solid and, therefore, the barometric leg and the collecting vessel are omitted. The operation is similar to that of the unit of FIG. 1, with the exception that the condensate is collected and disposed of as a solid, rather than a liquid.

The condensable gases (gasified metals) strike the surfaces of the plates 433 (533) and are condensed to a solid while the non-condensable gases are separated therefrom and withdrawn through the conduit 417 (517) by the vacuum pump. The temperature of the plates 433 (533) must be maintained within a range low enough to condense the metallic gases as a solid and yet high enough to prevent too great a heat loss from the chamber. The solid condensate is recovered by removing the condenser plates 433 (533) from the chamber and heating them to the condensate melting temperature in a furnace having a reducing atmosphere.

VARIABLE FACTORS

The process of the invention is subject to variable factors which will be discussed as follows:

Starting Materials

The nature of the starting material, which may be determined by analysis, will determine, to some extent, the optimum conditions employed, and these may be arrived at by experiment.

Condenser Temperature

There are two possible modes of condenser operation; one in which the gasified metallic vapors are condensed as liquid and the other in which it is condensed as solid. To this end, the temperature of the condenser controls in which mode the unit operates.

In the liquid condensing mode, the condenser temperature depends on the composition of the condensing vapors. At the commencement of refining the condensate has a lower melting point because there is a higher proportion of impurities in the vapor condensing compared to the latter stages when the proportion of the metal undergoing refining is greater.

In the solid condensing mode, the condenser temperature is adjusted so that at no time does the condensate liquify. As in the liquid condensing case, condenser temperature can increase throughout a treatment because the melting point of the condensate increases as the quantity of impurity decreases with respect to the amount of iron evaporating.

Liquid Metal Temperature

The temperature of the liquid metal is primarily determined by the tapping temperature of the prior operation less any temperature loss associated with the transfer of the ladle of liquid metal to beneath the distillation unit. Liquid metal temperature then continues to decrease (unless some corrective action is taken) due to further heat losses from both the ladle and distillation unit.

In starting up, the entire unit should be preheated to operating temperature and the proper differential between the temperature of the gas coming off and the temperature of the condenser.

Time

The processing time may range up to one hour. Processing time is affected by (i) amount of refining desired: 0 to substantially 100% elimination of initial impurities (preferred, 75–90% elimination);

(ii) liquid metal temperature;

(iii) agitation: quiescent to violent turbulence (preferred, violent turbulence);

(iv) distillation unit interior pressure;

(v) injected gas flow rate.

Pressure

Distillation unit interior pressure varies from atmospheric, between cycles and when the unit is not in operation, to pressures which will normally be in the range from 100 to 500 pascals during treatment.

The chamber pressure should be reduced to the operating level as fast as possible. This increases the productivity of the process.

Mixing or Lifting Gas

The mixing or lifting gas may be any non-condensable gas comprising either pure gas or a mixture of gases where the gases may be either reactive or inert. Preferably, it is argon gas mixed with quantities of either oxidizing gares such as oxygen or carbon dioxide or reducing gases such as carbon monoxide or hydrocarbon gas. (Nitrogen could be used in the process to reduce cost in cases where it is non-reactive. Freon (trade mark of E.I. Du Pont de Nemours & Co. for a series of fluorocarbon products) could be used in conjunction with an inert gas when chlorination and/or fluorination is desired).

Characteristics of the Bath of Molten Metal

A bath of molten metal within the distillation unit (i.e. above the legs) acts as a collector for the liquid metal which has been lifted via the up-leg and as a site for elimination of impurities leaving the surface directly.

The bath depth may be in the range 0.01 to 1.0 m (preferred 0.2 to 0.5 m). Bath surface area may range from 0.06 $m^2$ to 0.033 $m^2$ per tonne of metal treated. Bath volume in the range 0.006 $m^3$ to 0.033 $m^3$ per tonne of metal treated.

Condenser

The condenser leads evaporated volatile metal vapor away from the liquid metal surface by virtue of placing a sink for the metal vapor at a location remote from the liquid metal surface. The area of the condensing surface is large enough so that the liquid condensate forms either a liquid film which will adhere to and flow down the surface and into the condensate trough without dripping off the surface back into the molten metal or a solid mass which will not interfere with the flow of non-condensable gas to the outlet.

The condenser has sufficient surface area to capture 100% of the condensable gases evolving in the distillation unit. Its surface area is in the range 3 $m^2$ to 0.3 $m^2$ per tonne of metal treated (preferred 0.60 $m^2$ to 0.35 $m^2$ per tonne of metal treated.

Process Reactions

The reactions occurring during treatment are as follows:

(i) In the case of an inert lifting gas:

$$\text{impure metal} \xrightarrow[\text{distillation}]{\text{vacuum}} \text{purified metal} + \text{condensed impurities}$$

(ii) In the case of an oxidizing lifting gas:

$$\text{impure metal} \xrightarrow[\text{oxidation}]{\text{vacuum distillation}} \text{purified metal} + \text{condensed impurities}$$

(iii) In the case of a reducing lifting gas:

$$\text{impure metal} \xrightarrow[\text{reduction}]{\text{vacuum distillation}} \text{carburized purified metal} + \text{condensed impurities}$$

Agitation

Agitation contributes to creating a clean surface area on the metal in the receptacle for exposure to the action of the vacuum, increases the surface area exposed to vacuum, and increases the liquid phase mass transfer. All these factors increase the refining rate.

In the distillation unit, agitation is caused by the rise of the gas bubbles through the liquid metal and their breaking through the liquid metal/vacuum interface.

Materials of Construction

The distillation unit has a demountable vacuum-tight steel casing which supports the inner refractory lining. The unit is designed to treat all grades of steel and iron alloys and therefore the lining material is resistant to both chemical and thermal degradation. The most common and readily available grades suitable for application in each area of the unit should be used having regard for the new more expensive, but more robust grades of refractories such as those manufactured from silicon nitride, zirconia or alumina based refractory ceramics.

EXAMPLE 1

The following is an example of treating copper. The copper treated was impure copper containing:

| |
|---|
| 0.0001–0.05–0.5–1.0% Bi |
| 0.0001–0.05–3.0–5.0% As |
| 0.0001–0.05–0.5–1.0% Sb |
| 0.0001–0.05–3.0–5.0% Pb |
| 0.0001–0.05–3.0–5.0% Sn |
| 0.0001–0.002–0.08–0.2% Ag |
| 0.0001–0.05–0.5–1.0% Cd |
| 0.0001–0.05–0.5–1.0% Mg |
| 0.0001–0.05–0.5–1.0% Mn |

The operating temperature was within the range from 1350° K to 1800° K (preferred range 1525° to 1600° K). The chamber pressure was from 1 to 1000 pascals (preferably 100 to 500 pascals and in particular 133 pascals).

In order to achieve 80% removal of bismuth within one hour from a 35 kg bath of copper, a surface area of about 0.3 square meters, was exposed to vacuum via the action of the lift-spray apparatus. This represents about a ten-fold increase in bath surface area compared to quiescent conditions. The bulk gas velocity was from 1 to 100 meters per second, 5 to 20 meters per second being preferred.

Lifting gas was injected at a flow rate of about 90 grams per hour. The lift height was about 0.1 to 0.3 meters.

EXAMPLE 2

The following is an example of treating 35 tons of molten aluminum. The operating temperature is within the range from 900° to 1300° Kelvin (1050° to 1150° Kelvin preferred). The chamber pressure is from 1 to 1000 pascals, 100 to 500 pascals being preferred. The starting aluminum has a composition containing 0.01 to 5.0% magnesium.

In order to obtain 80% removal of the magnesium, within 30 minutes, a surface area of molten metal, preferably 80 to 110 $m^2$ is exposed to vacuum, and bulk gas velocity of 5 to 20 meters per second of lifting gas.

The flow rate of the injected lifting gas was about 70 kilograms per hour.

The lift height was about 0.5 to 1.5 meters.

We claim:

1. A process for removing metallic impurities from a metal having a low vapor pressure, comprising, selecting an apparatus provided with a receptacle containing a bath of a molten metal having a low vapor pressure and a vacuum chamber and at least one conduit extending from below the surface of the molten metal to a point above the molten metal in the vacuum chamber, to provide for a metal fall under vacuum, condensing means in the upper reaches of the vacuum chamber for condensing rising metallic gases, continuously injecting a lifting gas into a lower part of said conduit whereby liquid metal is lifted therethrough by the action of the expanding rising gases and discharged in finely divided form by the explosive release of lifting gas to drop in a metal fall onto the surface of the molten metal in the receptacle and a mixture is formed of said lifting gas and gases evaporating from said molten metal, subjecting the vacuum chamber to a vacuum effective, in the presence of the lifting gas, to cause a bulk flow of rising gases between the molten metal surface and the condensing means, said vacuum being lower than that which would cause a bulk flow of rising gases in the absence of lifting gas, continuously condensing the metallic rising gases on the condensing means to prevent reflux of impurities into the molten metal, thereby to increase the speed of removal of metallic impurities, restoring the pressure to normal, and recovering the treated metal.

2. A process, according to claim 1, in which said molten metal is aluminum.

3. A process, according to claim 1, in which said molten metal is nickel.

4. A process, according to claim 1, in which said molten metal is copper.

5. A process, according to claim 1, in which said molten metal is titanium.

6. A process, according to claim 2, in which the melt temperature is within the range from about 900° to about 1300° Kelvin.

7. A process, according to claim 2, in which the starting aluminum contains 0.01 to 5.0% magnesium and the process was conducted for 30 minutes resulting in 80% of initial magnesium being removed.

8. A process, according to claim 6, in which the starting aluminum contains 0.01 to 5.0% magnesium and the process was conducted for 30 minutes resulting in 80% of initial magnesium being removed.

9. A process, according to claim 1, in which said metal is copper and including continuously lifting liquid copper from a lower level in the bath to at least the surface of the bath to create a circulation within the bath to promote transfer of metallic impurities to the metal surface, and maintain the metal surface free of contamination.

10. A process, according to claim 1, wherein said apparatus has a lift factor of 0.5 to 1.5.

11. A method of vacuum refining a molten metal having a low vapor pressure comprising, forming a mixture of rising lifting gas and metallic gases evaporating from the surface of the molten metal, and subjecting the surface of the molten metal to a vacuum effective, in the presence of the lifting gas, to cause a bulk flow of rising gases from the molten metal surface, said vacuum having a pressure higher than the pressure required to cause a bulk flow of rising gases in the absence of lifting gas.

12. A method, according to claim 11, including the step of continuously removing the metallic component of the rising gases to prevent return of impurities into the molten metal.

13. A method, according to claim 12, wherein the metal component is removed by condensation.

14. A method, according to claim 11, wherein said mixture is formed by injecting lifting gas through said molten metal and discharging liquid metal entrained in said lifting gas above the metal surface to drop in a metal fall onto said surface.

15. A method, according to claim 11, wherein said metal is aluminum.

16. A method according to claim 11, wherein said metal is copper.

* * * * *